US008056179B2

(12) United States Patent
Hsu

(10) Patent No.: US 8,056,179 B2
(45) Date of Patent: Nov. 15, 2011

(54) CENTRIFUGAL WATER SEPARATOR FOR MOP

(76) Inventor: Hsing Yuan Hsu, Taichung County (TW)

( * ) Notice: Subject to any disclaimer, the term of this patent is extended or adjusted under 35 U.S.C. 154(b) by 401 days.

(21) Appl. No.: 12/454,214

(22) Filed: May 14, 2009

(65) Prior Publication Data

US 2010/0287724 A1 Nov. 18, 2010

(51) Int. Cl.
*A47L 13/58* (2006.01)

(52) U.S. Cl. ..... 15/260; 15/264; 34/58; 68/23.3; 68/241

(58) Field of Classification Search ..... 15/260, 15/263, 264; 34/58; 68/23 R, 23.3, 241; 210/360.1, 280.1, 280.2, 403
See application file for complete search history.

(56) References Cited

U.S. PATENT DOCUMENTS

2009/0151399 A1* 6/2009 Lin ..... 68/23 R
* cited by examiner

*Primary Examiner* — Mark Spisich
(74) *Attorney, Agent, or Firm* — Charles E. Baxley

(57) ABSTRACT

A centrifugal water separator for mop includes a bucket including a first chamber and a second chamber respectively defined therein. The first chamber and the second chamber are separated from each other. A separating trough is rotatably mounted in the second chamber in the bucket. A driving device is mounted in the first chamber in the bucket for driving the separating trough. A handle is pivotally mounted to the bucket. An indentation is defined in the handle and co-axially corresponding to the separating trough for holding the mop during separating water.

15 Claims, 8 Drawing Sheets

CENTRIFUGAL WATER SEPARATOR FOR MOP

BACKGROUND OF THE INVENTION

1. Field of the Invention

The present invention relates to centrifugal water separator, and more particularly to a centrifugal water separator for mop.

2. Description of Related Art

Conventional centrifugal water separators for mop in accordance with the prior art usually use gears of a rope for driving a shaft to rotate a separating trough. However, the step motion from the operator is equivalently transformed to the total rotating route of the shaft such that the rotating effect of the separating trough can not be effectively increased. Accordingly, the water separating effect is low. It is a laborious design and will waste a lot of time for separating water from the head of a mop because the operator needs to quickly repeated his/her step motion for speeding the rotating rate of the separating trough. In addition, the rotating axis of a mop is easily to be biased because there in no structure to keep the rotating axis of the mop linearly corresponding to that of the separating trough. Consequently, the separating trough will cause a great vibration due to the rotating mop.

The present invention has arisen to mitigate and/or obviate the disadvantages of the conventional centrifugal water separator for mop.

SUMMARY OF THE INVENTION

The main objective of the present invention is to provide an improved centrifugal water separator for mop which holds a shaft of the mop to prevent the mop from a serious vibration during separating water.

To achieve the objective, the centrifugal water separator in accordance with the present invention comprises a bucket including a first chamber and a second chamber respectively defined therein. The first chamber and the second chamber are separated from each other. Two ears respectively extend from an upper edge of the bucket and facing to each other. Each ear has a slot downward defined therein and a groove laterally defined therein. A separating trough is rotatably mounted in the second chamber in the bucket. A driving device is mounted in the first chamber in the bucket for driving the separating trough. A handle has a bow-shaped frame with two ends respectively pivotally mounted to a corresponding one of the two ears. An indentation is defined in the frame and co-axially corresponding to the separating trough for holding a shaft of the mop during separating water. The frame has two opposite ends respectively formed with an insertion portion selectively inserted into a corresponding one of the two slots. Each insertion portion has a pivot outwardly and laterally extending therefrom, and extending through and moved along a corresponding one of the two grooves in each of the ears.

Further benefits and advantages of the present invention will become apparent after a careful reading of the detailed description with appropriate reference to the accompanying drawings.

DETAILED DESCRIPTION OF THE INVENTION

Figure 1:
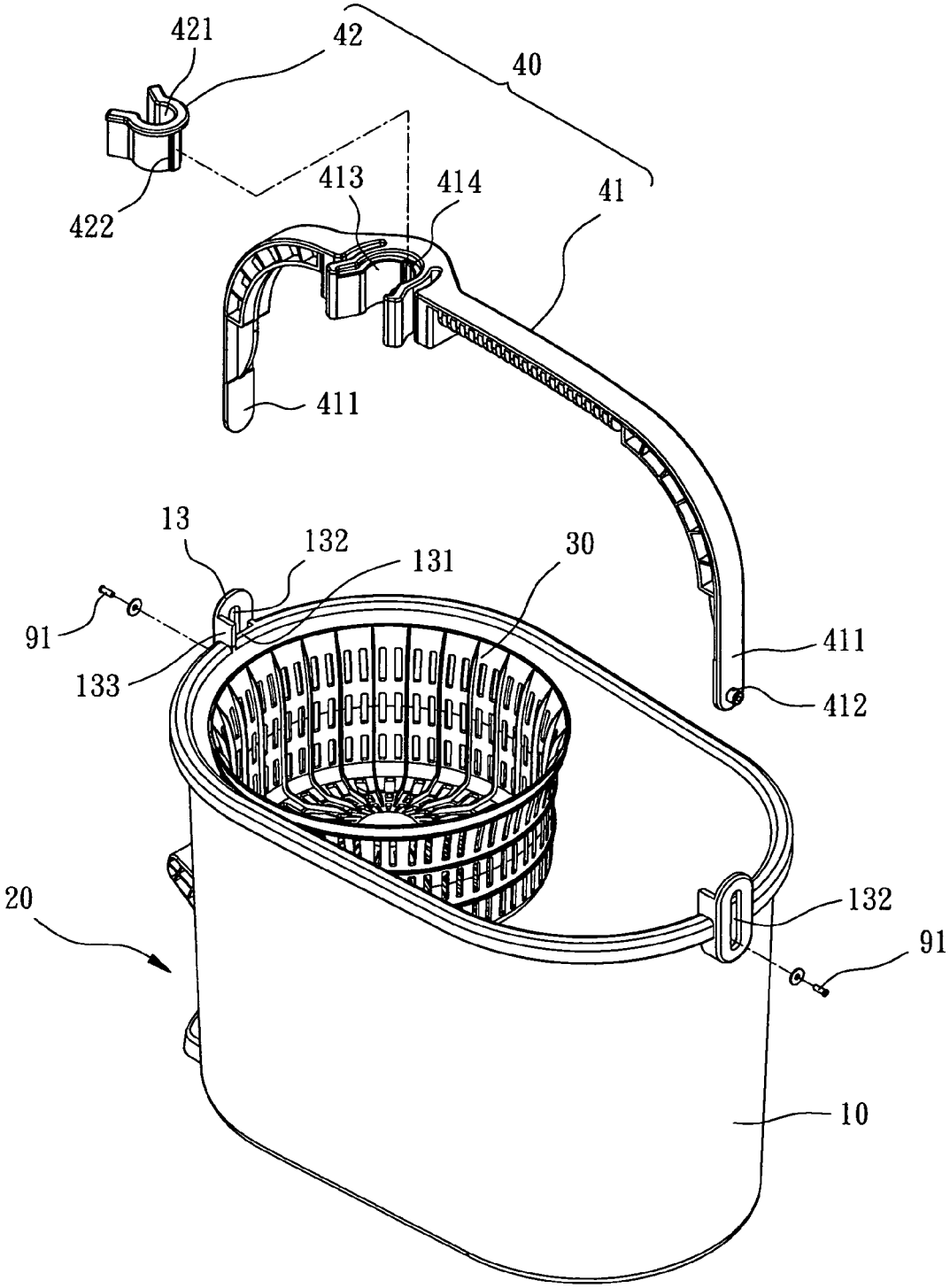
FIG. 1 is an exploded perspective view of a centrifugal water separator for a mop in accordance with the present invention.

Referring to the drawings and initially to FIGS. 1-8, a centrifugal water separator for mop in accordance with the present invention comprises a bucket (10), a driving device (20) mounted in the bucket (10), a separating trough (30) mounted upon the driving device (20) and a handle (40) mounted to a top edge of the bucket (10).

Figure 2:
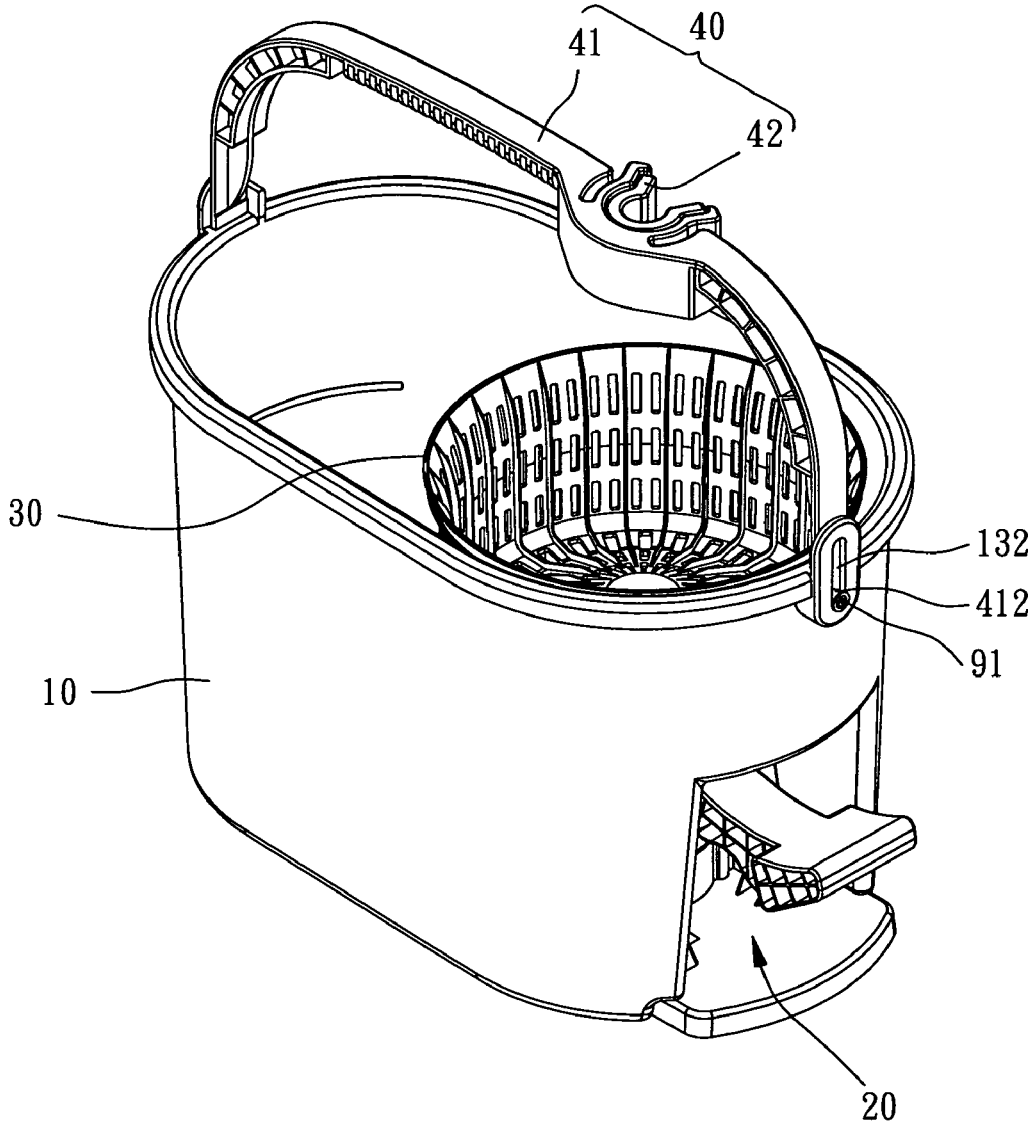
FIG. 2 is a perspective view of the centrifugal water separator for a mop in accordance with the present invention.
Figure 3:
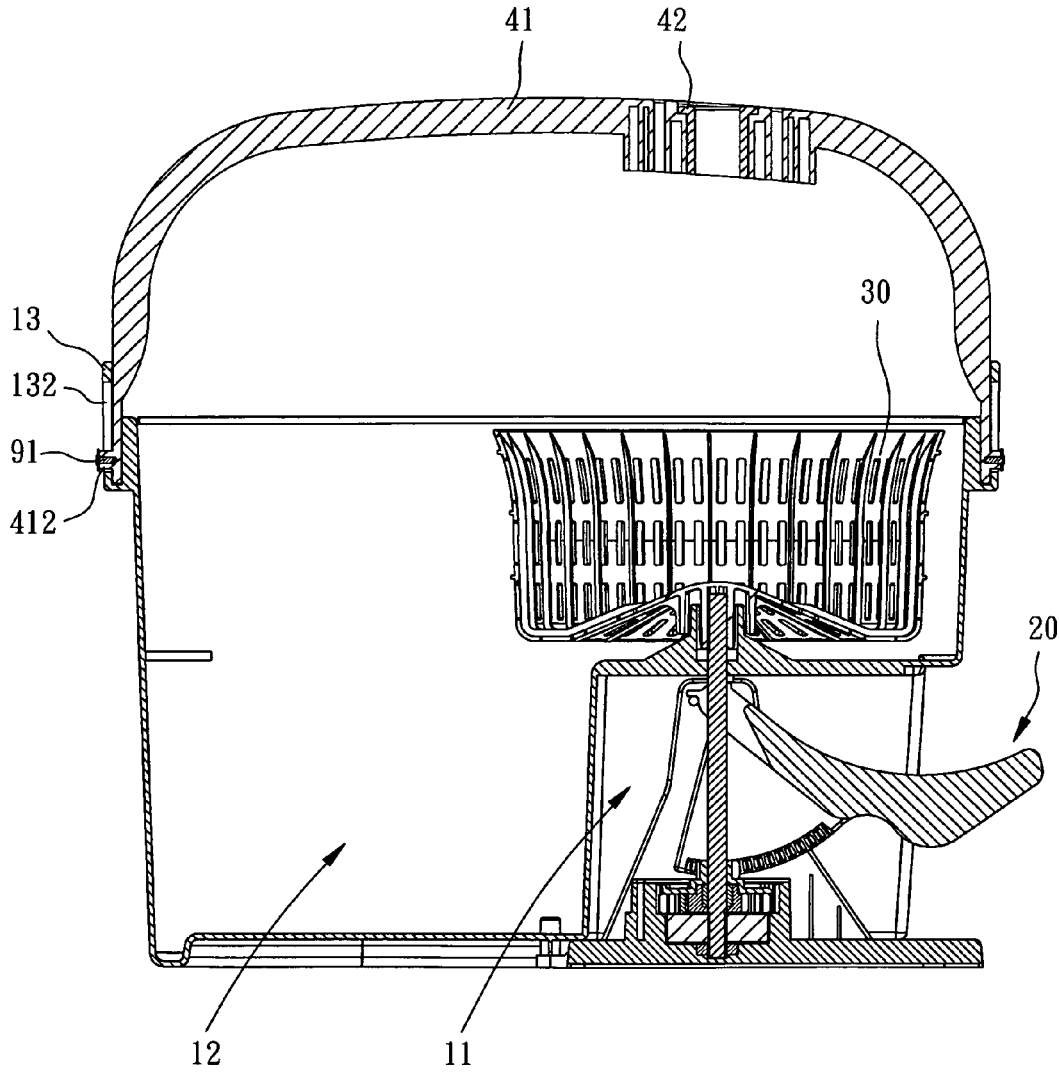
FIG. 3 is a cross-sectional view of the centrifugal water separator for a mop in accordance with the present invention.
Figure 4:
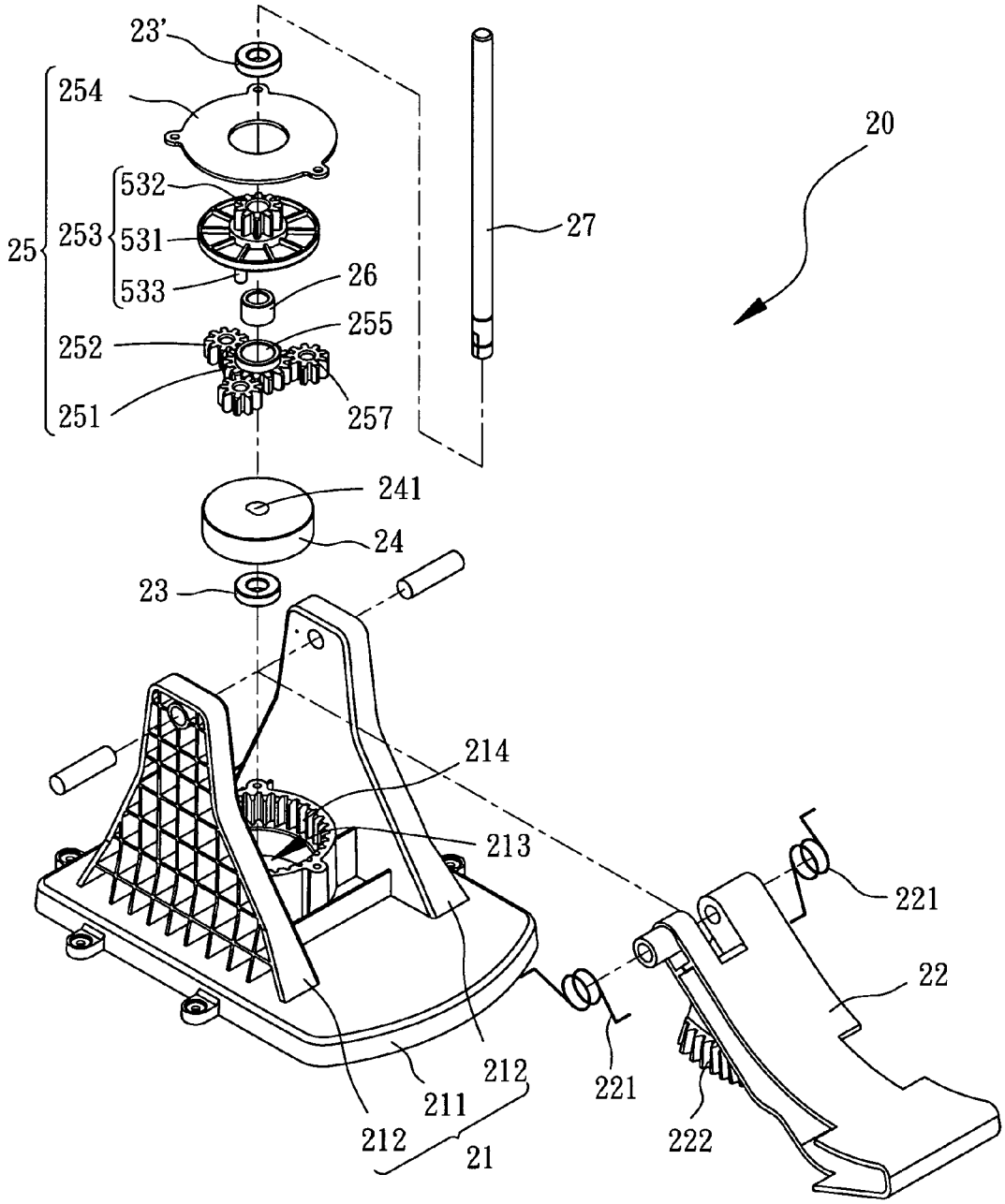
FIG. 4 is an exploded perspective view of a driving device of the centrifugal water separator in accordance with the present invention.
Figure 5:
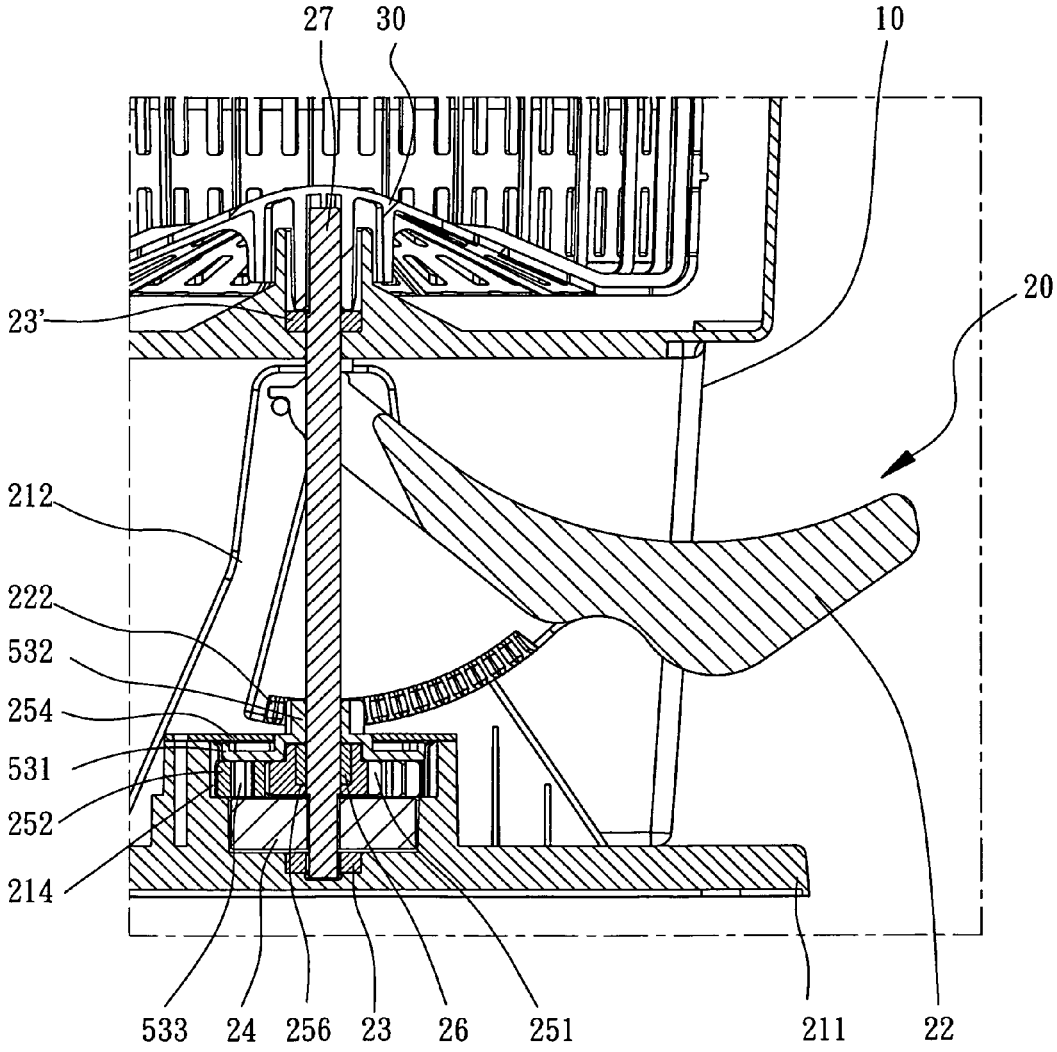
FIG. 5 is a partially cross-sectional view of the centrifugal water separator of the present invention.

With reference to FIGS. 1-3, the bucket (10) includes a first chamber (11) defined therein for receiving the driving device (20) and a second chamber (12) defined therein for containing water. The first chamber (11) and the second chamber (12) are separated from each other. The first chamber (11) has a lateral opening and the second chamber (12) has an upward opening. The bucket (10) has two ears (13) upwardly extending from an upper edge thereof and facing each other. Each ear (13) has a slot (131) downward defined therein and a groove (132) laterally defined therein. The groove (132) communicates with the slot (131). Two stoppers (133) respectively upwardly extend from the upper edge of the bucket (10) and each is connected to one side of a corresponding one of the two ears (13). Each slot (131) is tapered relative to a depth thereof.

With reference to FIGS. 3-6, the driving device (20) includes a seat (21) received in the first chamber (11). The seat (21) has a base plate (211) secured on a bottom of the first chamber (11) and two 20 supports (212) upwardly extending from the base plate (211). A sunken hole (213) is defined in the base plate (211) between the two supports (212). A ring gear (214) is formed on the base plate (211) and surrounds the sunken hole (213). A pedal (22) has a first end pivotally mounted to an upper portion of each of the two supports (212) and a second end extending over the periphery of the bucket (10). The pedal (22) is reciprocally wiggled relative to the seat (21). Two springs (221) are mounted to two opposite sides of the pedal (22) for lifting the second end of the pedal (22) when the pedal (22) is in a free condition. A curved toothed edge (222) is formed on a lower side of the pedal (22) relative to a pivot of the pedal (22).

A first bearing (23) and a second bearing (23') are respectively secured in a bottom of the sunken hole and the bucket (10). The first bearing (23) and the second bearing (23') are parallel to each other and linearly corresponding to each other. An inertia sprocket wheel (24) is rotatably received in the sunken hole (213) above the first bearing (23). The inertia sprocket wheel (24) has a through hole (241) centrally defined therein.

A planet gear set (25) is mounted within the ring gear (214). The planet gear set (25) includes a sun gear (251) located on a center of the ring gear (214) and three planet gears (252) equally surrounding the sun gear (251). Each planet gear (252) is engaged to the ring gear (214) and the sun gear (251) and has a through hole (257) centrally defined therein. A through hole (255) is centrally defined in the sun gear (251) and a shoulder (256) inwardly and radially extending from a lower portion of the through hole (255). A drive element (253) is partially and rotatably received within the ring gear (214) for driving the three planet gears (252). The drive element (253) comprises a disc (531) including a first side having three stub (533) extending therefrom and a second side having a gear (532) centrally extending therefrom. Each stub (533) is pivotally received in a through hole (257) in a corresponding one of the three planet gears (252). A one-way clutch bearing (26) is securely received in the through hole (255) and abuts against the shoulder (256). A cover (254) is mounted to an upper portion of the ring gear (214) to prevent the inertia sprocket wheel (24), the sun gear (251), the planet gears (252) and the drive element (253) from detaching from the seat (21). The gear (532) extends through the cover (254).

An axle (27) has a first end sequentially extending through the second bearing (23'), the drive element (253), the one-way clutch bearing (26), the inertia sprocket wheel (24) and the first bearing (23), wherein the axle (27) is partially securely received in the one-way clutch bearing (26) and synchronously rotated with the inertia sprocket wheel (24).

With reference to FIGS. 1-5, the separating trough (30) is rotatably mounted in the second chamber (12) above the first chamber (11) and has a bottom longitudinally securely to a second end of the axle (27) such that the separating trough (30) is rotated with the axle (27).

With reference to FIGS. 1 and 3, the handle (40) has a bow-shaped frame (41) and a clamp (42) detachably received in the frame (41). The frame (41) has two opposite ends respectively formed with an insertion portion (411). The insertion portion (411) is tapered relative to the shape of the corresponding slot (131). Each insertion portion (411) has a pivot (412) outwardly and laterally extending therefrom, and extending through and moved a corresponding one of the two grooves (132). Each pivot (412) has a bolt (91) longitudinally screwed thereinto to prevent the handle (40) from detaching from the bucket (10). An indentation (413) is defined in the frame (41) and linearly corresponds to the axle (27). A groove (414) is longitudinally defined in an inner periphery of the indentation (413). A clamp (42) is slidably mounted into the frame (41) and selectively received in the indentation (413). A passage (421) is longitudinally defined in the clamp (42) and a rib (422) is formed on an outer periphery of the clamp (42). The rib (422) is slidably and selectively received in the groove (414) in the frame (41) to limit the rotation of the clamp (42) when being received in the indentation (413).

Figure 7:
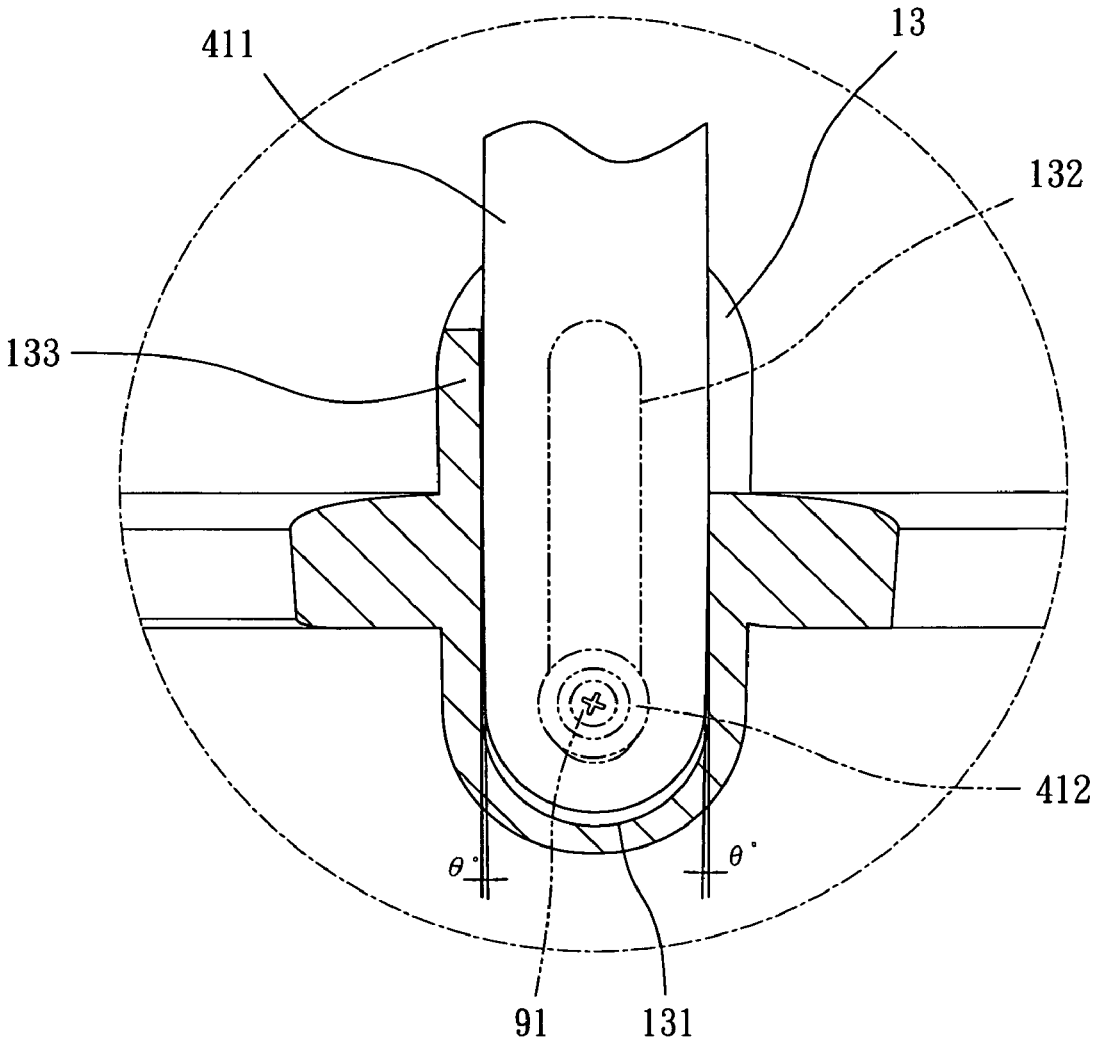
FIG. 7 is a partial enlarged view in cross-section of the bucket of the centrifugal water separator in accordance with the present invention.
Figure 8:
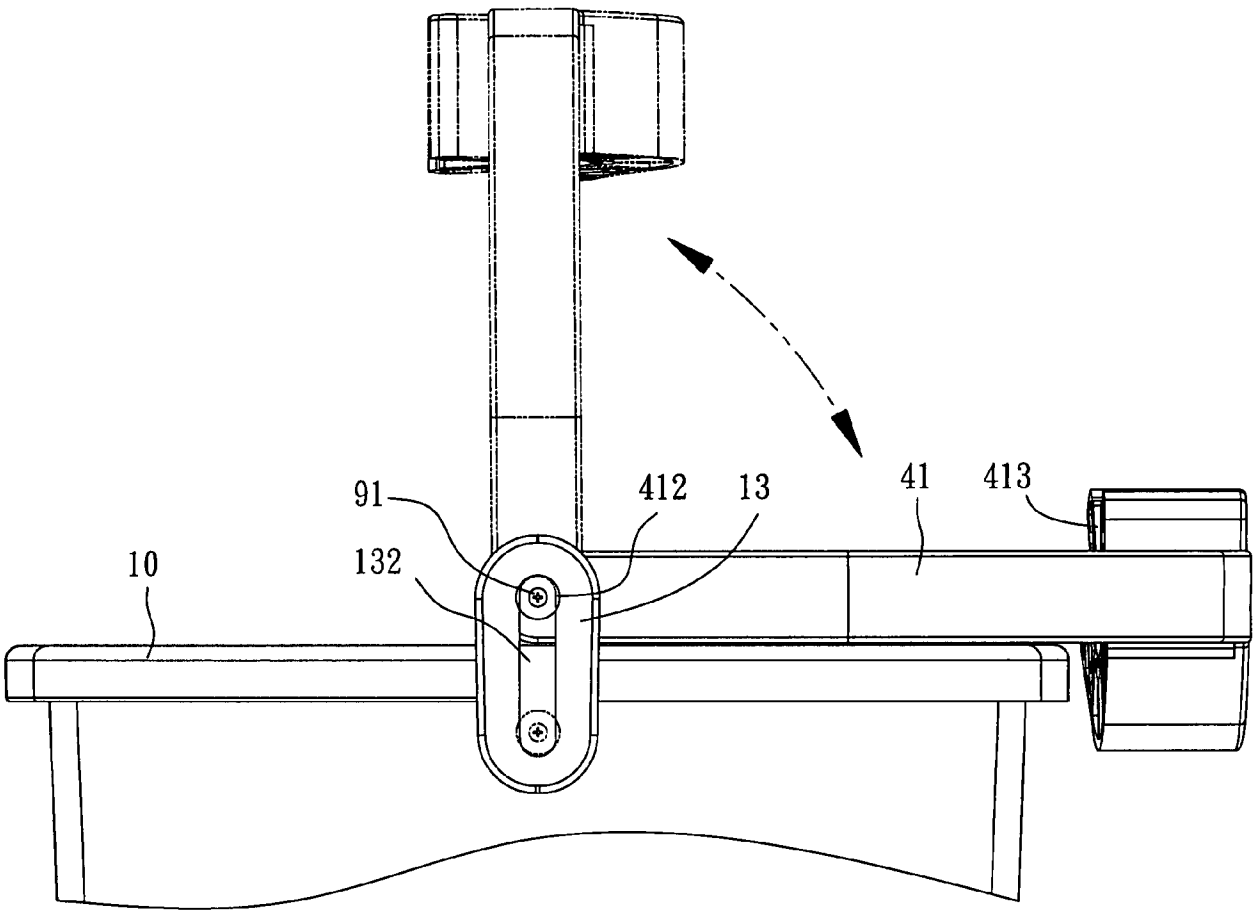
FIG. 8 is an operational view of a handle of the centrifugal water separator of the present invention.

With reference to FIG. 8, when separating water from the mop (not shown), the handle (40) is lifted and perpendicular relative to a supporting plane such that the indentation (413) co-axially corresponds to the separating trough (30) and the axle (27). Each insertion portion (411) is inserted into a corresponding one of the two slots (131) for positioning the handle (40), as shown in FIG. 7. The shaft of the mop is laterally inserted into the indentation (413) such that the mop co-axially corresponds to the separating trough (30). The curved toothed edge (222) of the pedal (22) drives the drive element (253) to drive the planet gear set (25) when the user repeatedly steps the pedal (22). The planet gears (252) respectively execute a rotation along the periphery of the ring the gear (214) and execute a revolution relative to the sun gear (251) for driving the sun gear (251). The one-way clutch bearing (26) drives the axle (27) with the separating trough (30) to rotate the mop for separating water from the mop when the sun gear (251) is driven by the planet gears (252).

Figure 6:
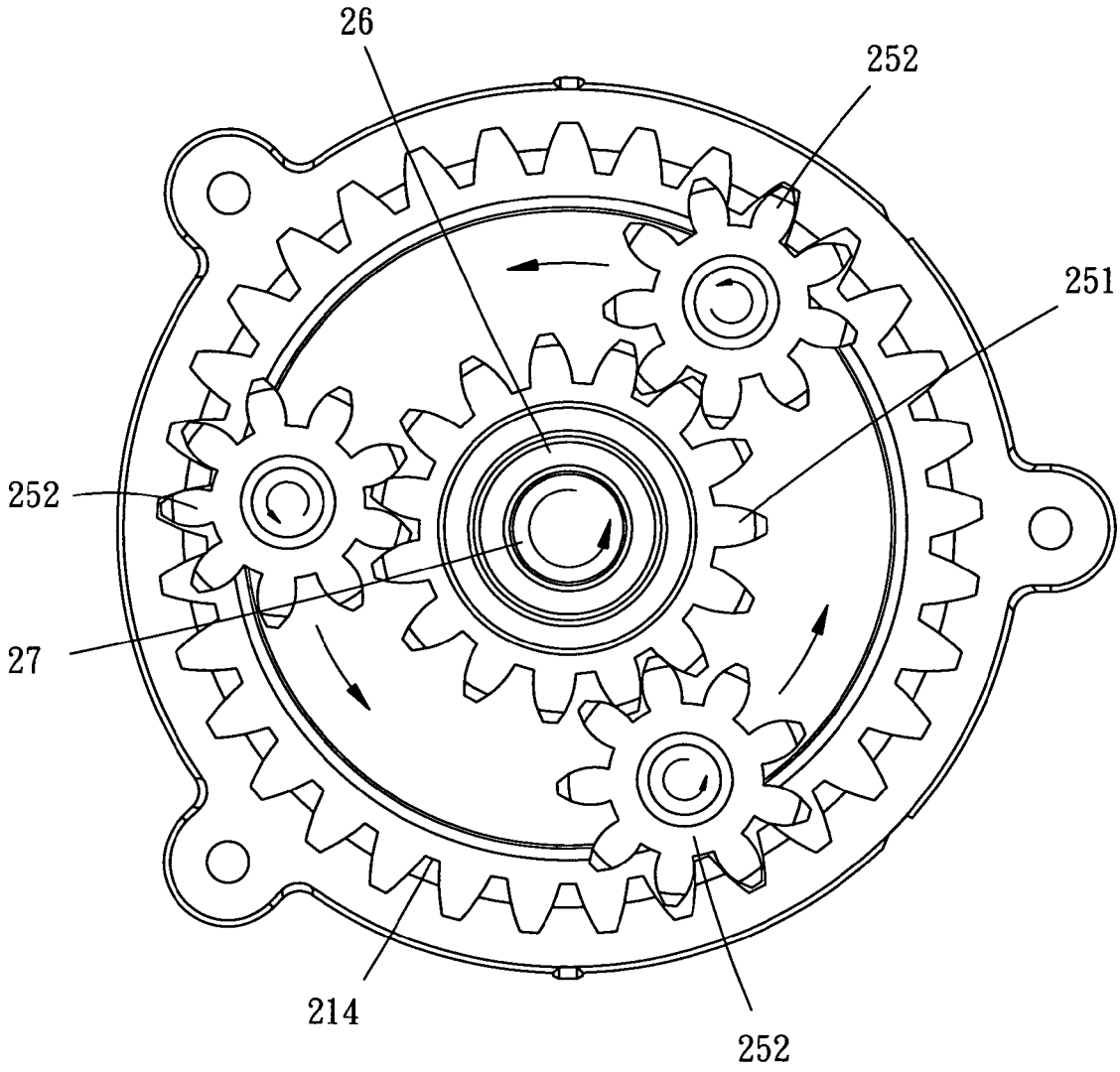
FIG. 6 is a top plan view of a planet gear set of the centrifugal water separator of the present invention.

The axle (27) and the separating trough (30) continually rotates due to the inertia sprocket wheel (24) and the one-way clutch bearing (26) is idle relative to the axle (27) when the pedal (22) is lifted to its original position due to the springs (221). With reference to FIG. 6, in the preferred embodiment of the present invention, the planet gear set (25) is used as a speed increaser for achieving a purpose of labor-saving.

The two insertion portions (411) are respectively and complementally inserted into a corresponding one of the two slots (131) after the handle (40) being perpendicular relative to the supporting plane. Consequently, the handle (40) and the mop are stable when the separating trough (30) is rotated. When folding the handle (40). The handle (40) is perpendicularly lifted to make each insertion portion (411) disengaged from the corresponding slot (131) such that the handle (40) can be moved to one side of the bucket (10) in one-way due to the stoppers (133). Furthermore, the clamp (42) is selectively mounted into the indentation (413) when the diameter of the shaft of the mop is smaller than that of the indentation (413).

Although the invention has been explained in relation to its preferred embodiment, it is to be understood that many other possible modifications and variations can be made without departing from the spirit and scope of the invention as hereinafter claimed.

What is claimed is:

1. A centrifugal water separator for mop, comprising:

a bucket including a first chamber and a second chamber respectively defined therein, the first chamber and the second chamber separated from each other, two ears respectively extending from an upper edge of the bucket and facing to each other, each ear having a slot downward defined therein and a groove laterally defined therein;

a drive device partially received in the first chamber, the drive device including a seat received and secured in the first chamber, a sunken hole defined in a bottom portion of the seat and a ring gear formed on the seat surrounding the sunken hole, a pedal pivotally mounted to the seat and reciprocally wiggle relative to the seat, a curved toothed edge formed on a lower side of the pedal relative to the pivot of the pedal, a planet gear set mounted within the ring gear, the planet gear set including a sun gear located on a center of the ring gear and multiple planet gears equally surround the sun gear, each planet gear engaged to the ring gear and the sun gear, a drive element co-axially and rotatably mounted to the planet gear set for driving the multiple planet gears and engaged to the curved toothed edge of the pedal, an axle having a first end extending through the drive element and the sun gear, the axle selectively driven by the sun gear;

a separating trough longitudinally and securely mounted to a second end of the axle and rotatably received in the second chamber in the bucket; and a handle having a bow-shaped frame with two ends respectively pivotally mounted to a corresponding one of the two ears, an indentation defined in the frame and co-axially corresponding to the separating trough, the frame having two opposite ends respectively formed with an insertion portion selectively inserted into a corresponding one of the two slots, each insertion portion having a pivot outwardly and laterally extending therefrom, and extending through and moved along a corresponding one of the two grooves in each of the ears.

2. The centrifugal water separator as claimed in claim 1, wherein the seat includes a base plate secured on a bottom of the first chamber and two supports upwardly extending from the base plate, the sunken hole defined between the two supports, the pedal having a first end pivotally mounted to an upper portion of each of the two supports and a second end extending over the periphery of the bucket, two springs respectively mounted to two opposite sides of the pedal for lifting the pedal when the pedal is in a free condition.

3. The centrifugal water separator as claimed in claim 1, wherein the drive device includes a first bearing and a second bearing respectively securely in a bottom of the sunken hole and the bucket, the first bearing and the second bearing parallel to each other and linearly corresponding to each other, the axle having a first end sequentially extending through the second bearing, the drive element and the first bearing.

4. The centrifugal water separator as claimed in claim 1, wherein the drive device includes an inertia sprocket wheel rotatably received in the sunken hole, the axle centrally extending through the inertia sprocket wheel and synchronously rotated with the inertia sprocket wheel.

5. The centrifugal water separator as claimed in claim 1, wherein the sun gear has a through hole for securely receiving a one-way clutch bearing, the axle extending through the one-way clutch bearing such that the axle is selectively drive by the one-way clutch bearing when the pedal is stepped.

6. The centrifugal water separator as claimed in claim 5, wherein the sun gear has a shoulder inwardly and radially extending from a lower portion of the through hole in the sun gear for supporting the one-way clutch bearing.

7. The centrifugal water separator as claimed in claim 1, wherein each planet gear has a through hole centrically defined therein and the drive element has a disc having a gear centrically extending from the disc, the gear engaged to the curved toothed edge of the pedal, multiple stubs extending from the disc opposite to the gear, each stub received in a through hole in a corresponding one of the multiple planet gears such the sun gear is driven and the planet gear set is used as a speed increaser when the pedal is stepped.

8. The centrifugal water separator as claimed in claim 7, wherein the planet gear set includes a cover mounted to an upper portion of the ring gear to prevent the planet gear set and the drive element from detaching from the ring gear and the gear of the drive element extending through the cover.

9. The centrifugal water separator as claimed in claim 1, wherein the bucket includes two stoppers respectively upwardly extending from the upper edge of the bucket and each connected to one side of a corresponding one of the two ears for limiting a wiggle direction of the handle.

10. The centrifugal water separator as claimed in claim 1, wherein each slot is tapered relative to a depth thereof and each insertion portion is tapered relative to a shape of the corresponding slot.

11. The centrifugal water separator as claimed in claim 1, wherein the handle includes a groove longitudinally defined in an inner periphery of the indentation, a clamp slidably mounted into the frame and selectively received in the indentation, a passage longitudinally defined in the clamp and a rib formed on an outer periphery of the clamp, the rib slidably and selectively received in the groove in the frame to limit the rotation of the clamp when the clamp is received in the indentation.

12. A centrifugal water separator for mop, comprising:

a bucket including a first chamber and a second chamber respectively defined therein, the first chamber and the second chamber separated from each other, two ears respectively extending from an upper edge of the bucket and facing to each other, each ear having a slot downward defined therein and a groove laterally defined therein;

a separating trough rotatably mounted in the second chamber in the bucket;

a driving device mounted in the first chamber in the bucket for driving the separating trough; and a handle having a bow-shaped frame with two ends respectively pivotally mounted to a corresponding one of the two ears, an indentation defined in the frame and coaxially corresponding to the separating trough, the frame having two opposite ends respectively formed with an insertion portion selectively inserted into a corresponding one of the two slots, each insertion portion having a pivot outwardly and laterally extending therefrom, and extending through and moved along a corresponding one of the two grooves in each of the ears.

13. The centrifugal water separator as claimed in claim 12, wherein the bucket includes two stoppers respectively upwardly extending from the upper edge of the bucket and each connected to one side of a corresponding one of the two ears for limiting a wiggle direction of the handle.

14. The centrifugal water separator as claimed in claim 12, wherein each slot is tapered relative to a depth thereof and each insertion portion is tapered relative to a shape of the corresponding slot.

15. The centrifugal water separator as claimed in claim 12, wherein the handle includes a groove longitudinally defined in an inner periphery of the indentation, a clamp slidably mounted into the frame and selectively received in the indentation, a passage longitudinally defined in the clamp and a rib formed on an outer periphery of the clamp, the rib slidably and selectively received in the groove in the frame to limit the rotation of the clamp when the clamp is received in the indentation.

* * * * *